US009645591B2

(12) United States Patent
Roham et al.

(10) Patent No.: US 9,645,591 B2
(45) Date of Patent: May 9, 2017

(54) CHARGE SHARING LINEAR VOLTAGE REGULATOR

(71) Applicant: QUALCOMM Incorporated, San Diego, CA (US)

(72) Inventors: Masoud Roham, San Diego, CA (US); Wei Zheng, San Diego, CA (US); Liang Dai, San Diego, CA (US); Dinesh J. Alladi, San Diego, CA (US); Yuhua Guo, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 108 days.

(21) Appl. No.: 14/151,701

(22) Filed: Jan. 9, 2014

(65) Prior Publication Data

US 2015/0192943 A1 Jul. 9, 2015

(51) Int. Cl.
*G05F 1/56* (2006.01)
*G05F 1/575* (2006.01)

(52) U.S. Cl.
CPC ..... *G05F 1/56* (2013.01); *G05F 1/575* (2013.01)

(58) Field of Classification Search
CPC ..... G05F 1/56; G05F 1/575
USPC ..... 323/269
See application file for complete search history.

(56) References Cited

U.S. PATENT DOCUMENTS

| | | | | |
|---|---|---|---|---|
| 5,790,393 | A | 8/1998 | Fotouhi | |
| 6,400,211 | B1 * | 6/2002 | Yokomizo | H02M 3/07 327/536 |
| 6,759,836 | B1 * | 7/2004 | Black, Jr. | G05F 1/575 323/284 |
| 7,463,054 | B1 | 12/2008 | Parris et al. | |
| 7,495,420 | B2 | 2/2009 | Vinn | |
| 8,080,982 | B2 | 12/2011 | Lin et al. | |
| 8,248,150 | B2 | 8/2012 | Tadeparthy et al. | |
| 2008/0278124 | A1 * | 11/2008 | Aiura et al. | 323/267 |
| 2013/0033244 | A1 | 2/2013 | Ock | |
| 2013/0076320 | A1 | 3/2013 | Chan et al. | |

FOREIGN PATENT DOCUMENTS

EP 1065580 A1 1/2001

OTHER PUBLICATIONS

International Search Report and Written Opinion—PCT/US2015/010635—ISA/EPO—May 13, 2015.
Second Written Opinion from International Application No. PCT/US2015/010635, dated Dec. 10, 2015, 7 pp.

* cited by examiner

*Primary Examiner* — Jue Zhang
(74) *Attorney, Agent, or Firm* — Chui-Kiu Teresa Wong; Kenneth Vu

(57) ABSTRACT

Exemplary embodiments are related to voltage regulators. A device may include a first energy storage element coupled between a ground voltage and an output. The device may also include a second energy storage element coupled to the ground voltage and configured to selectively couple to the output. Further, the device may include a voltage regulator coupled between an input and the second energy storage element.

17 Claims, 7 Drawing Sheets

CHARGE SHARING LINEAR VOLTAGE REGULATOR

BACKGROUND

Field

The present invention relates generally to voltage regulators. More specifically, the present invention relates to embodiments for voltage regulators with a charging sharing loop.

Background

Power management plays an important role in the current day electronics industry. Battery powered and handheld devices require power management techniques to extend battery life and improve the performance and operation of the devices. One aspect of power management includes controlling operational voltages. Conventional electronic systems, particularly systems on-chip (SOCs) commonly include various subsystems. The various subsystems may be operated under different operational voltages tailored to specific needs of the subsystems. Voltage regulators may be employed to deliver specified voltages to the various subsystems. Voltage regulators may also be employed to keep the subsystems isolated from one another.

Low dropout (LDO) voltage regulators are commonly used to generate and supply low voltages, and achieve low-noise circuitry. Conventional LDO voltage regulators require a large external capacitor, frequently in the range of a several microfarads. These external capacitors occupy valuable board space, increase the integrated circuit (IC) pin count, and prevent efficient SOC solutions.

As will be appreciated by a person having ordinary skill in the art, a load coupled to a voltage regulator may require a large periodic current (i.e., during an active load period), which may lead to a substantial droop in an output voltage. This droop may adversely affect the functionality of the load. Further, an abrupt current draw from an input voltage port (e.g., an input pin of an integrated circuit) to compensate a load current may generate large ripples at the input voltage, thus causing noise for other blocks supplied by the input voltage.

A need exists for an enhanced linear voltage regulator. More specifically, a need exists for embodiments related to voltage regulators including a charge sharing loop.

DETAILED DESCRIPTION

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, well-known structures and devices are shown in block diagram form in order to avoid obscuring the novelty of the exemplary embodiments presented herein.

Figure 1:
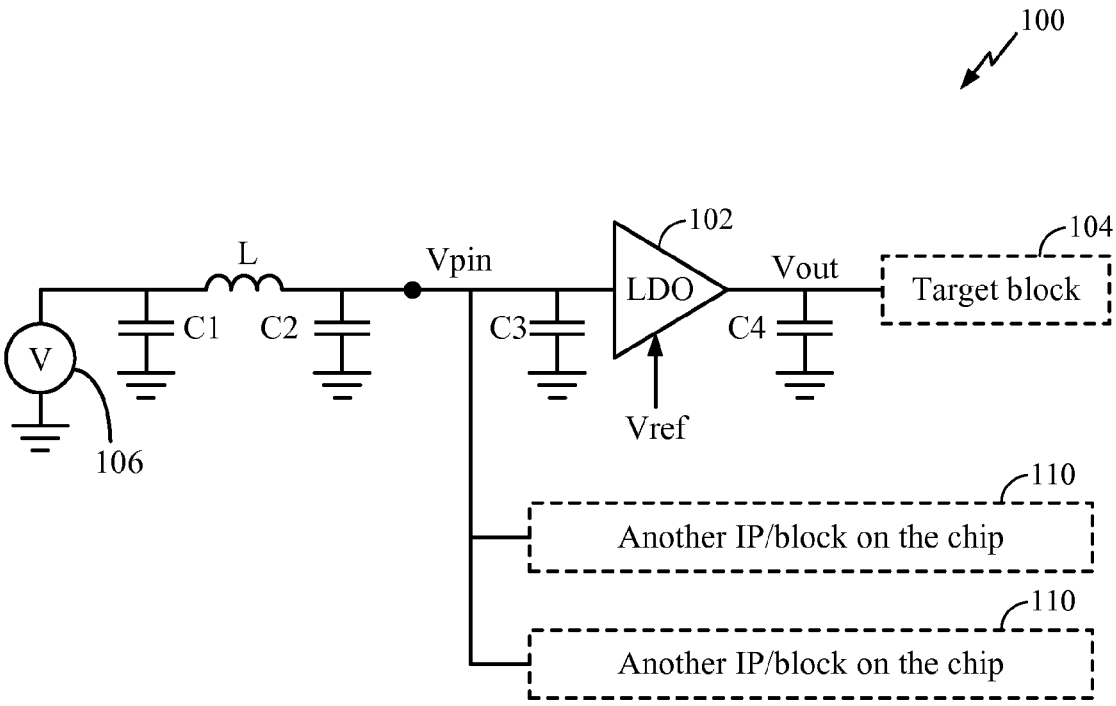
FIG. 1 is a device including a low-dropout (LDO) voltage regulator.

FIG. 1 illustrates a device 100 including a low-dropout (LDO) voltage regulator 102 configured for receiving an input voltage Vpin (e.g., a voltage at an input pin of an integrated circuit) and conveying an output voltage Vout to a load 104, which is depicted as a target block in FIG. 1. Voltage regulator 102 may also be configured to receive a reference voltage Vref. Device 100 further includes a voltage source 106, capacitors C1-C4, and an inductor L. Moreover, device 100 may include one or more additional blocks 110 configured to receive input voltage Vpin.

Figure 2:
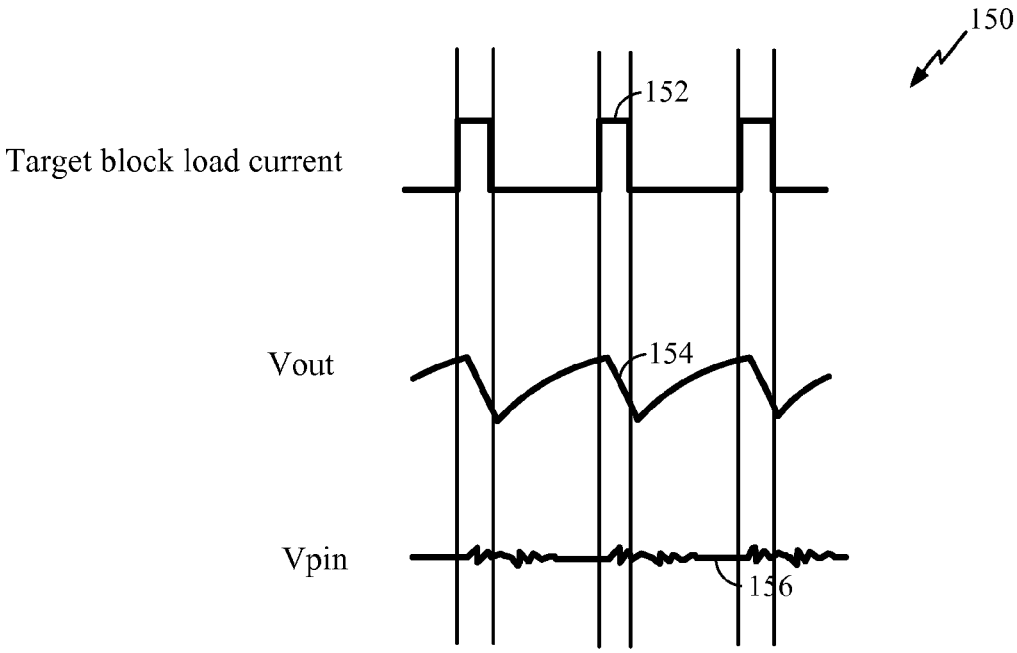
FIG. 2 is a plot depicting a load current, an output voltage, and an input voltage of a LDO voltage regulator.

FIG. 2 is a plot 150 including a load current depicted by reference numeral 152, an output voltage depicted by reference numeral 154, and an input voltage depicted by reference numeral 156. As will be appreciated by a person having ordinary skill in the art, a load (e.g., load 104 of device 100) may require a large periodic current (e.g., as shown by reference numeral 152 in plot 150). This current may lead to a substantial droop in an output voltage, as shown in reference numeral 154 of plot 150, which may affect the functionality of the (target block) load.

Figure 3:
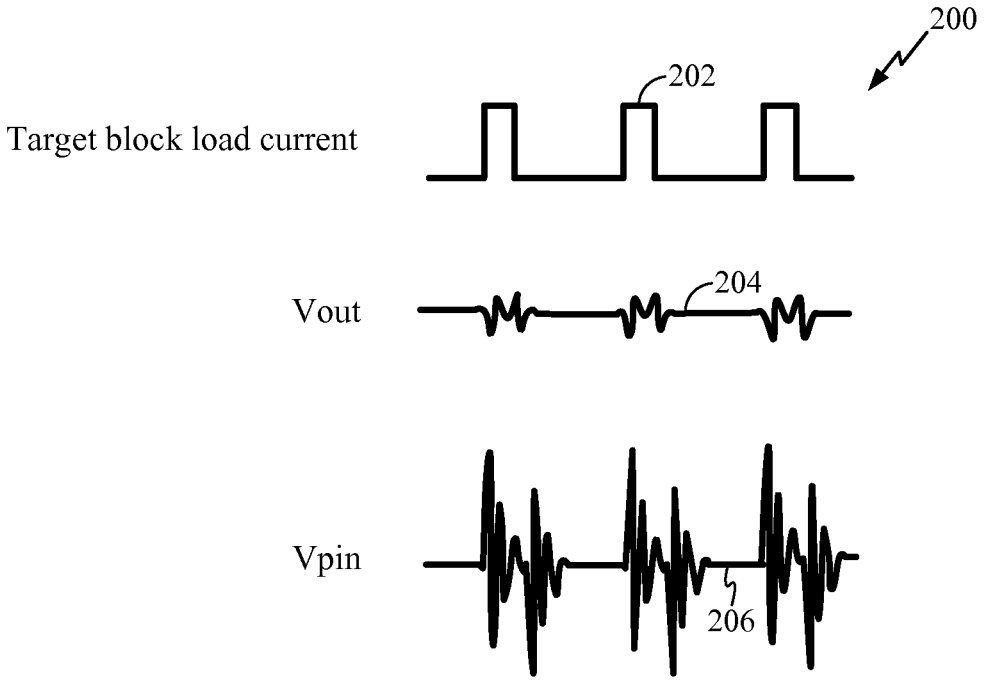
FIG. 3 is a plot depicting a load current, an output voltage, and an input voltage of another LDO voltage regulator.

With reference again to FIG. 1, as will be appreciated by a person having ordinary skill in the art, increasing a size of capacitor C4 may reduce the droop in output voltage Vout. However, this solution may require a large silicon area and is often not practical. Further, a fast response loop LDO voltage regulator, and/or a scheme that includes abrupt current draw from an input voltage (e.g., input voltage Vpin) to compensate a load current, may generate large ripples at the input causing noise for other blocks supplied by the input voltage. FIG. 3 is another plot 200 including a load current depicted by reference numeral 202, an output voltage depicted by reference numeral 204, and an input voltage depicted by reference numeral 206. As illustrated in FIG. 3, input voltage 206 includes large ripples due to an abrupt current draw from the input voltage to compensate for a load current.

Exemplary embodiments, as described herein, are related to voltage regulators. According to one exemplary embodiment, a device may include a first energy storage element coupled between a ground voltage and an output. The device may further include a second energy storage element coupled to the ground voltage and configured to selectively couple to the output. Additionally, the device may include a voltage regulator coupled between an input and the second energy storage element.

According to another exemplary embodiment, a device may include a voltage regulator configured to receive an input voltage and convey an output voltage to a first node. The device may also include a first energy storage element coupled between the first node and a ground voltage, and a second energy storage element coupled between the ground voltage and an output node. Moreover, the device may include a switch configured to couple the first energy storage element to the output node during an active load period.

In accordance with yet another exemplary embodiment, a device may include a first voltage regulator coupled between an input and a first output node, wherein the first output node is configured to couple to a load. Furthermore, the device may comprise a first capacitor coupled between a ground voltage and the first output node. In addition, the device may include a second voltage regulator coupled between the input and a second output node, and a second capacitor coupled between the ground voltage and the second output node. The device may further include a switch configured to couple the second output node to the first output node.

According to another exemplary embodiment, the present invention includes methods related to operation of a voltage regulator. Various embodiments of such a method may include charging a first energy storage element coupled to an output of a voltage regulator to a first voltage and charging a second energy storage element to a second voltage. The method may also include coupling the first energy storage element to the second energy storage element during an active load period. According to another exemplary embodiment, a method may include conveying a first output voltage from a first voltage regulator to a first capacitor coupled between a ground voltage and an output. Additionally, the method may include conveying a second output voltage from a second voltage regulator to a second capacitor coupled to the ground voltage. Further, the method may include selectively coupling the second capacitor to the output during an active load period.

Other aspects, as well as features and advantages of various aspects, of the present invention will become apparent to those of skill in the art through consideration of the ensuing description, the accompanying drawings and the appended claims.

Figure 4:
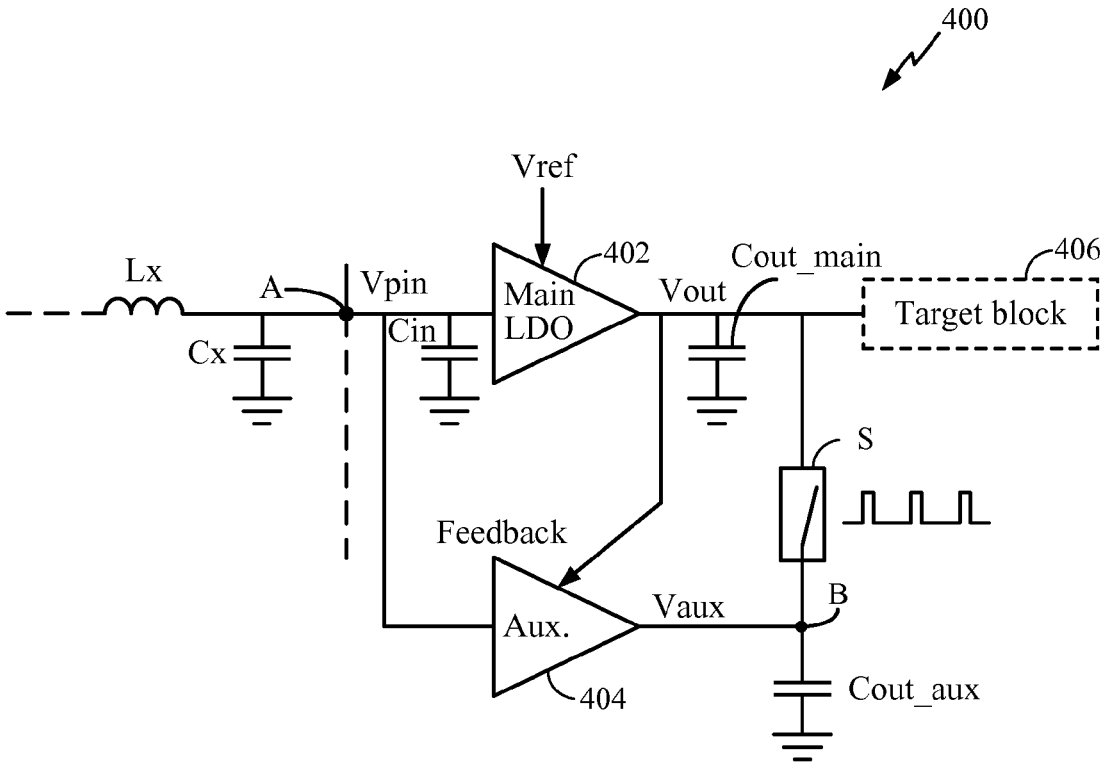
FIG. 4 is a device including a plurality of voltage regulators, according to an exemplary embodiment of the present invention.

FIG. 4 illustrates a device 400, according to an exemplary embodiment of the present invention. Device 400 includes an LDO voltage regulator 402 and an LDO voltage regulator 404. LDO voltage regulator 402 may also be referred to herein as a "main LDO regulator." Further, LDO voltage regulator 404 may also be referred to herein as an "auxiliary LDO regulator." Device 400 further includes an inductor Lx, a capacitor Cx, a capacitor Cin, a capacitor Cout_main, and a capacitor Cout_aux. Capacitor Cout_main may also be referred to herein as a "main capacitor" and capacitor Cout_aux may also be referred to herein as an "auxiliary capacitor." Furthermore, each of capacitor Cout_main, and a capacitor Cout_aux may be referred to herein as an "energy storage element." As illustrated in FIG. 4, capacitor Cx may be coupled between a ground voltage and a node A, capacitor Cin may be coupled between the ground voltage and an input of LDO voltage regulator 402, capacitor Cout_main coupled between the ground voltage and an output of LDO voltage regulator 402, and capacitor Cout_aux may be coupled between the ground voltage and an output of LDO voltage regulator 404.

With continued reference to FIG. 4, an input of LDO voltage regulator 402 is coupled to node A and is configured to receive an input voltage. As will be understood by a person having ordinary skill in the art, node A may comprise an input pin of, for example, an integrated circuit. Accordingly, node A may be referred to as an "input voltage pin" and the voltage received by voltage regulator 402 and voltage regulator 404 may be referred to as input voltage Vpin. Further, an output of LDO voltage regulator 402 is coupled to a target block 406 and is configured to convey an output voltage Vout to target block 406, which may also be referred to as a load.

An input of LDO voltage regulator 404 is coupled to node A is configured to receive the input voltage Vpin and an output of LDO voltage regulator 404 is coupled to a node B and is configured to convey another output voltage Vaux. Node B, which is coupled between a switch S and capacitor Cout_aux, may be switchably coupled to target block 406 via switch S. Further, voltage regulator 404 may be configured to receive a feedback voltage at an output of voltage regulator 402.

As will be appreciated by a person having ordinary skill in the art, in comparison to device 100 illustrated in FIG. 1, device 400 includes an LDO capacitor that is divided into two parts (i.e., capacitor Cout_main and capacitor Cout_aux). A first part (i.e., the main capacitor) may be charged with the regular LDO feedback to a target DC voltage. The second part (i.e., the auxiliary capacitor) may be charged to a voltage, which may, for example only, be greater than the target DC voltage. During an active load period (e.g., when a load requires a large periodic current), the boot capacitor (i.e., capacitor Cout_aux) may be switched into the output to compensate for the load current. Stated another way, during an active load period, each of capacitor Cout_main and capacitor Cout_aux may be coupled to target block 406. It is noted that controller (not shown in FIG. 4) may be configured to determine when an active load period will occur and, furthermore, may convey a signal to switch S for coupling each of capacitor Cout_main and capacitor Cout_aux may to target block 406 during an active load event. It is further noted that the voltage of both capacitors Cout_main and capacitor Cout_aux may be set by a slow switched feedback loop, which samples the main LDO voltage ripple. In such a scheme, auxiliary voltage Vaux may be controlled by a feedback loop which, as input error signal, uses the difference between output voltage Vout at the beginning of the load period and the end, or effectively the ripple value.

Figure 5:
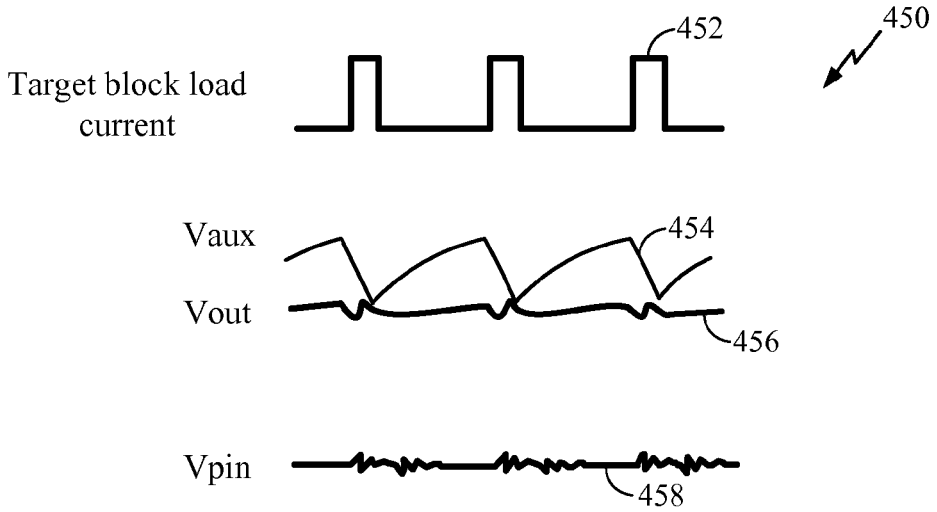
FIG. 5 is a plot depicting a load current, an auxiliary voltage, an output voltage, and an input voltage of the device of FIG. 4.

FIG. 5 is a plot 450 depicting a load current 452, an auxiliary voltage 454, an output voltage 456, and an input voltage 458. It is noted that load current 452 may represent a current conveyed to target block 406 (see FIG. 4), auxiliary voltage 454 may represent a voltage at node B (i.e., Vaux) (see FIG. 4), output voltage 456 may represent output voltage Vout, and input voltage 458 may represent a voltage conveyed to an input of LDO voltage regulator 402 and LDO voltage regulator 404 (i.e., input pin voltage Vpin).

In comparison to conventional devices, the output voltage ripple of device 400 may be significantly reduced, a total capacitor size of device 400 may be reduced, or both. Further, an abrupt current draw from node A may be reduced and, therefore, a large ripple may not be induced on the input voltage supplied to voltage regulator 402 and LDO voltage regulator 404. In addition, the second feedback loop (i.e., feedback from output voltage Vout to LDO voltage regulator 404) may avoid under-compensation (i.e. large output ripples), over-compensation (i.e. drift of output voltage to higher than set), or both.

Figure 6:
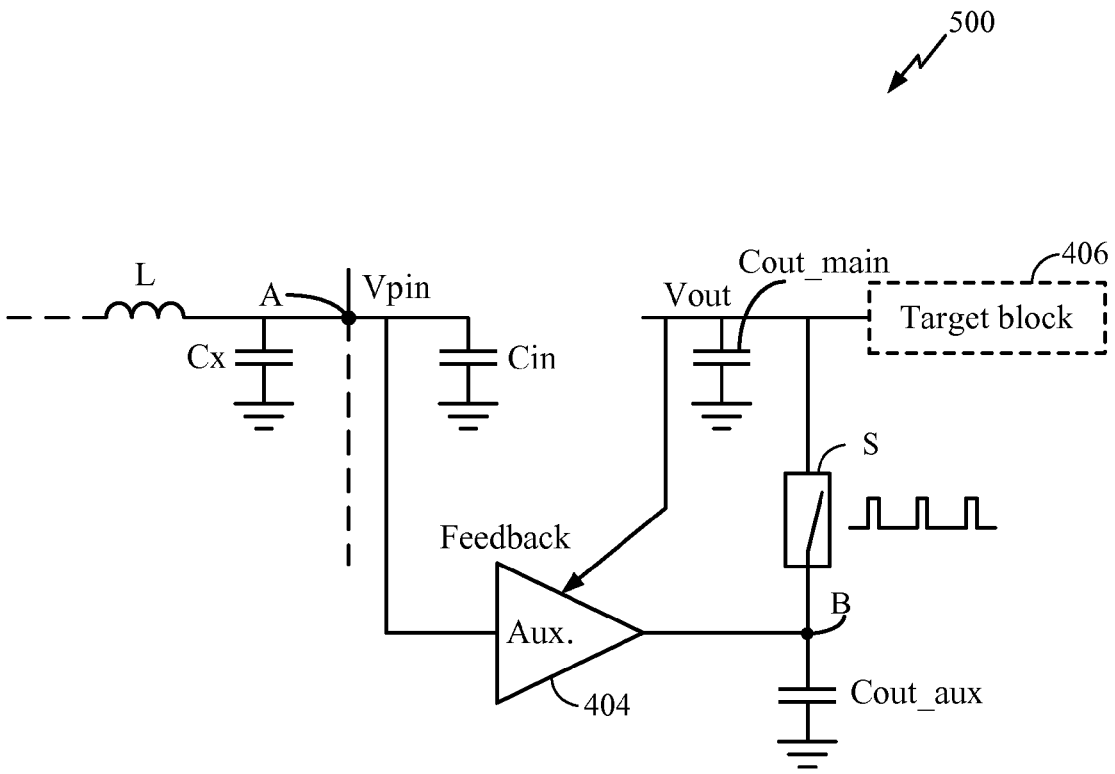
FIG. 6 depicts another device including a voltage regulator, in accordance with an exemplary embodiment of the present invention.

As will be appreciated by a person having ordinary skill in the art, in a case wherein a non periodic portion of a load is very small, the main voltage regulator provides little to no current. Therefore, in accordance with an exemplary embodiment of the present invention, the main LDO voltage regulator may be omitted and the boost loop provides all current for the load. FIG. 6 illustrates another device 500, according to an exemplary embodiment of the present invention. Device 500 includes an LDO voltage regulator 404, which may also be referred to herein as an "auxiliary LDO regulator." Device 500 further includes inductor Lx, capacitor Cx, capacitor Cin, capacitor Cout_main, and capacitor Cout_aux. As illustrated, capacitor Cx may be coupled between a ground voltage and node A, capacitor Cin may be coupled between the ground voltage and node A, capacitor Cout_main is coupled between the ground voltage and an output of device 500, and capacitor Cout_aux may be coupled between the ground voltage and an output of LDO voltage regulator 404 (i.e., coupled between the ground voltage and a target block).

An input of LDO voltage regulator 404 is coupled to node A and is configured to receive input voltage Vpin and an output of LDO voltage regulator 404 is coupled to node B and is configured to convey another output voltage Vaux. Node B, which is coupled between switch S and capacitor Cout_aux, may be switchably coupled to target block 406 via switch S. Further, voltage regulator 404 may be configured to receive a feedback voltage at an output of voltage regulator 402.

Figure 7:
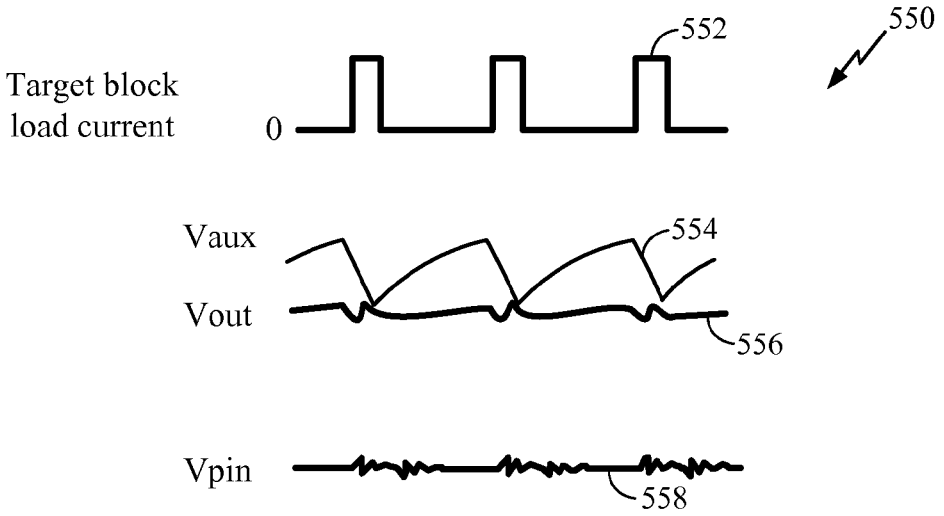
FIG. 7 is a plot depicting a load current, an auxiliary voltage, an output voltage, and an input voltage of the device of FIG. 6.

FIG. 7 is a plot 550 depicting a load current 552, an auxiliary voltage 554, an output voltage 556, and an input voltage 558. It is noted that load current 552 may represent a current conveyed to target block 406 of device 500 (see FIG. 6), auxiliary voltage 554 may represent a voltage at node B (i.e., Vaux) (see FIG. 6), output voltage 556 may represent output voltage Vout, and input voltage 558 may represent a voltage conveyed to an input of LDO voltage regulator 404 (i.e., input pin voltage Vpin). In comparison to conventional devices, an abrupt current draw from an input voltage may be reduced and, therefore, a large ripple may not be induced on the input voltage supplied to voltage regulator 404.

Figure 8:
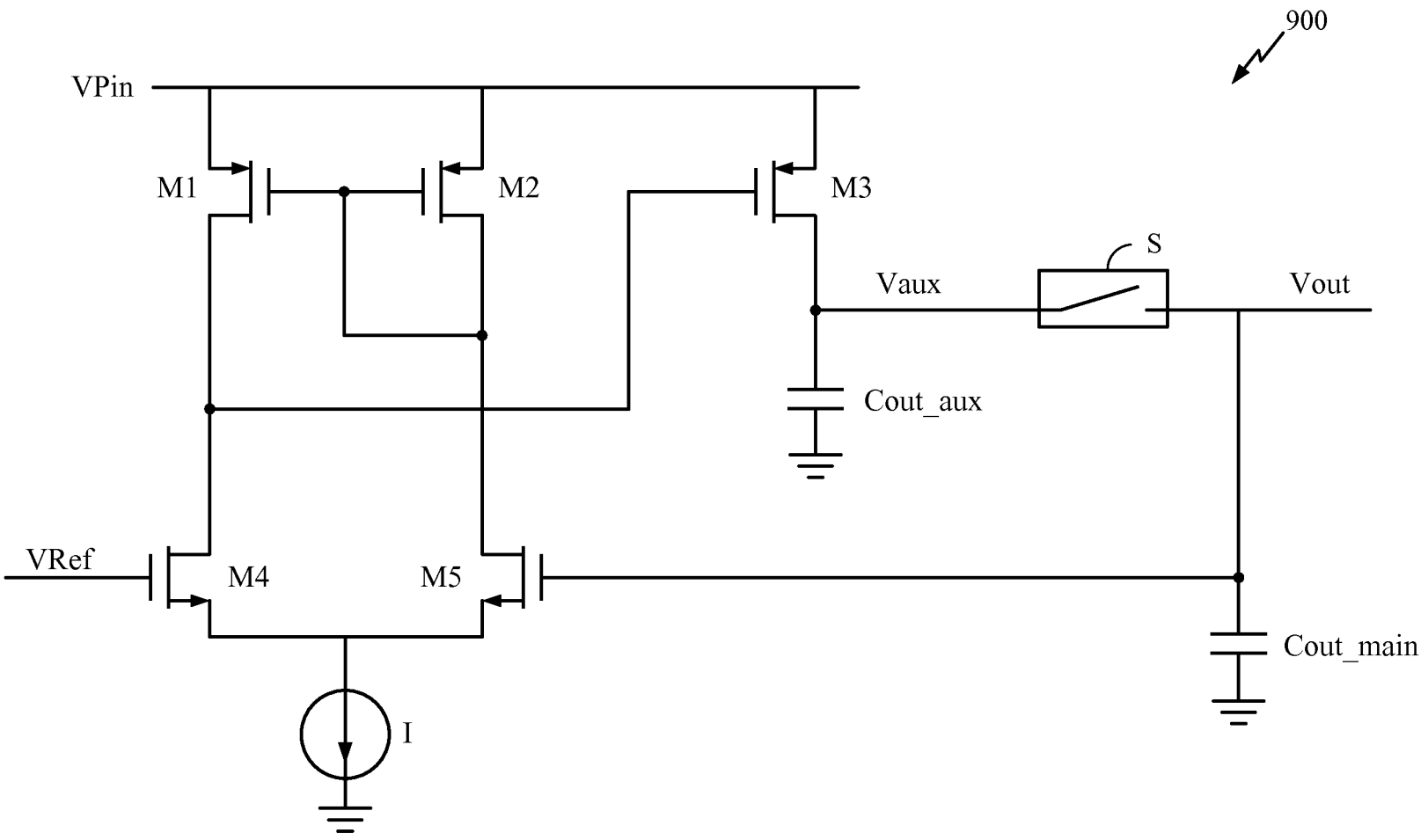
FIG. 8 illustrates an example circuit diagram for implementing the device of FIG. 6.

FIG. 8 is an example circuit diagram 900 for implementing device 500 illustrated in FIG. 6. Circuit diagram 900 includes a plurality of transistors M1-M5, capacitors Cout_main and Cout_aux, switch S, and a current source I. As illustrated, a transistor M1 may be coupled between input voltage Vpin and a transistor M4, which is further coupled to current source I. More specifically, a source of transistor M1 is coupled to input voltage Vpin, a drain of transistor M1 is coupled to a drain of transistor M4, and a source of transistor M4 is coupled to current source I. Further, a transistor M2 may be coupled between input voltage Vpin and a transistor M5, which is further coupled to current source I. More specifically, a source of transistor M2 is coupled to input voltage Vpin, a drain of transistor M2 is coupled to a drain of transistor M5, and a source of transistor M5 is coupled to current source I.

In addition, a gate of transistor M1 may be coupled to a gate of transistor M2, which is further coupled to the drain of transistor M2. A gate of transistor M4 is configured to receive a reference voltage VREF. A transistor M3 is coupled between input voltage Vpin and capacitor Cout_aux, which is further coupled to a ground voltage. More specifically, a source of transistor M3 is coupled to input voltage Vpin and a drain of transistor M3 is coupled to a node C, which is coupled to ground voltage GRND via capacitor S capacitor Cout_aux YS. Moreover, a gate of transistor M3 is coupled to a drain of transistor M1 and a drain of transistor M4. Furthermore, node C is switchably coupled to an output of circuit diagram 600 via switch S. A gate of transistor M5 is coupled to a node D, which is coupled between the output of circuit diagram 900 and capacitor Cout_main. Capacitor Cout_main is further coupled to ground voltage GRND.

Figure 9:
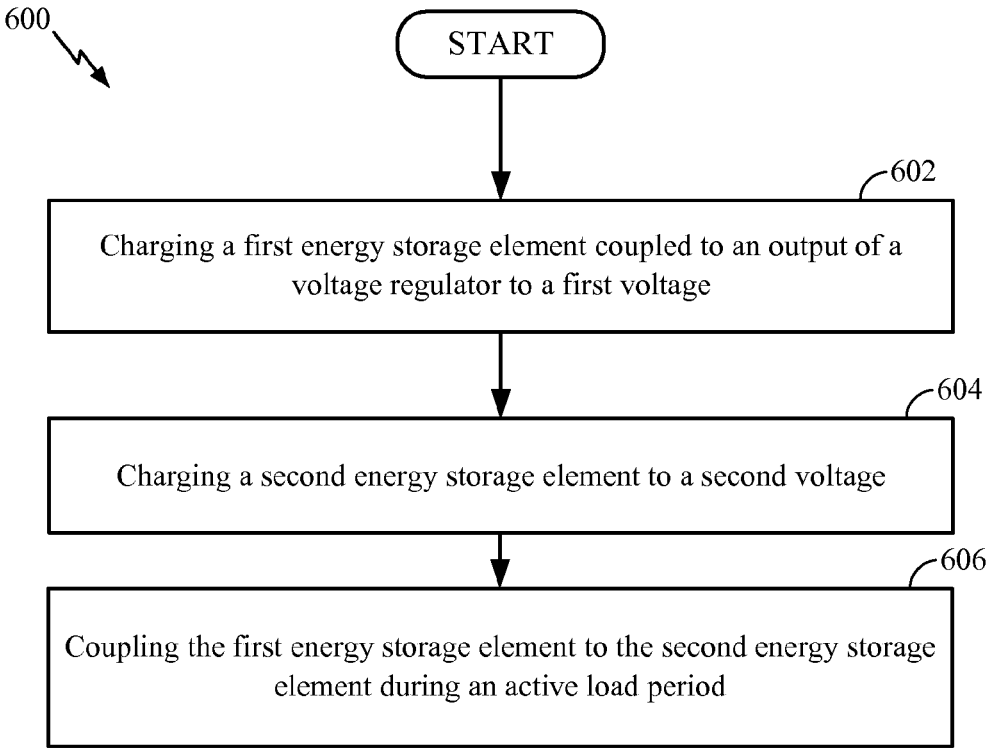
FIG. 9 is a flowchart depicting a method, in accordance with an exemplary embodiment of the present invention.

FIG. 9 is a flowchart illustrating a method 600, in accordance with one or more exemplary embodiments. Method 600 may include charging a first energy storage element coupled to an output of a voltage regulator to a first voltage (depicted by numeral 602). Method 600 may also include charging a second energy storage element to a second voltage (depicted by numeral 604). In addition, method 600 may include coupling the first energy storage element to the second energy storage element during an active load period (depicted by numeral 606).

Figure 10:
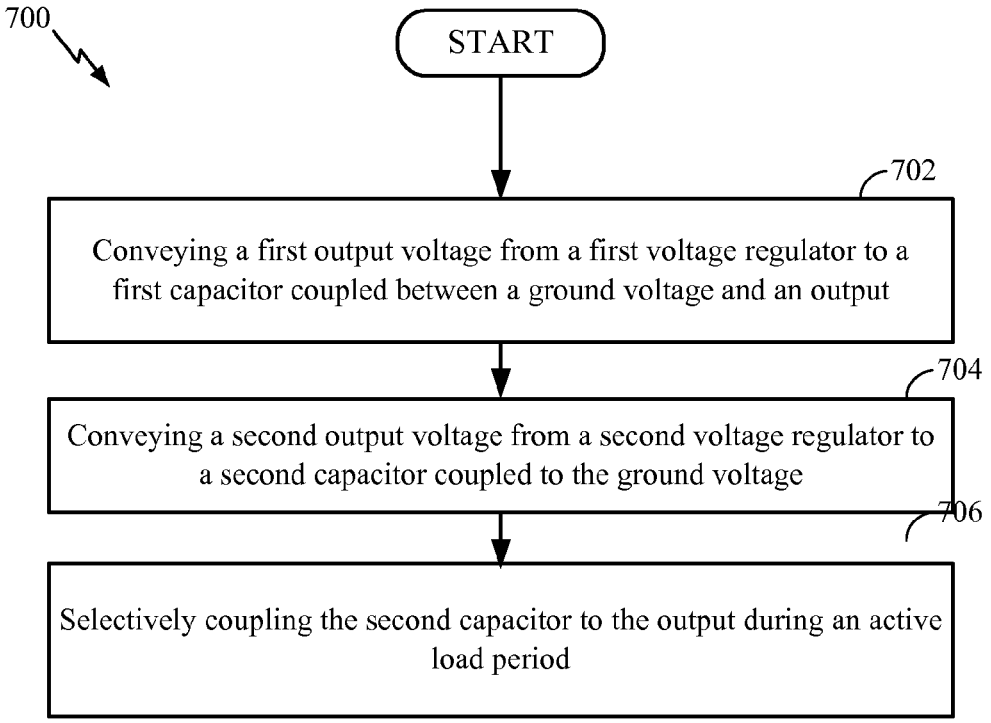
FIG. 10 is a flowchart depicting another method, in accordance with an exemplary embodiment of the present invention.

FIG. 10 is a flowchart illustrating another method 700, in accordance with one or more exemplary embodiments. Method 700 may include conveying a first output voltage from a first voltage regulator to a first capacitor coupled between a ground voltage and an output (depicted by numeral 702). In addition, method 700 may also conveying a second output voltage from a second voltage regulator to a second capacitor coupled to the ground voltage (depicted by numeral 704). Method 700 may also include selectively coupling the second capacitor to the output during an active load period (depicted by numeral 706).

Figure 11:
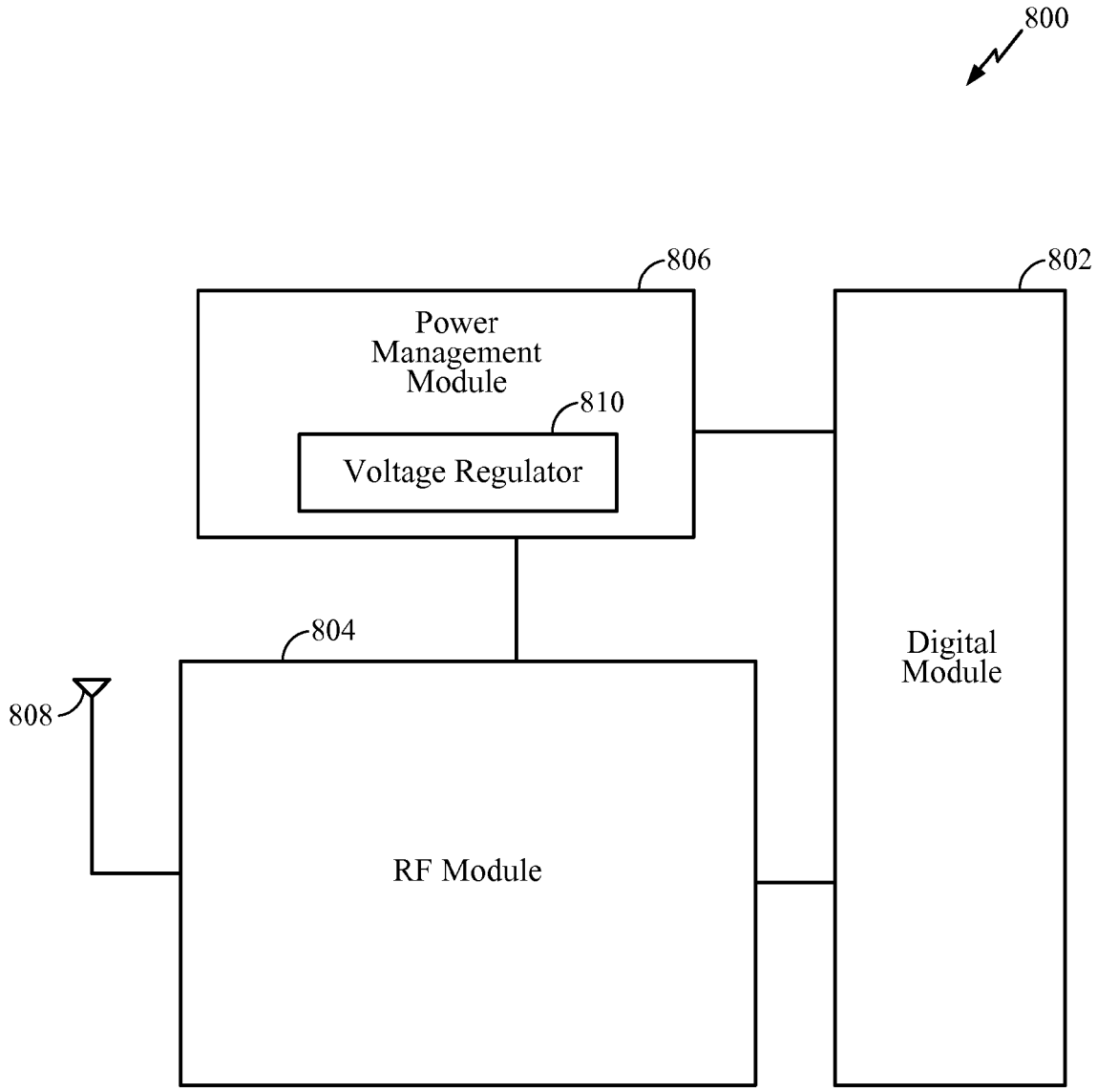
FIG. 11 illustrates a device including a power management module having one or more voltage regulators, in accordance with an exemplary embodiment of the present invention.

FIG. 11 is a block diagram of an electronic device 800, according to an exemplary embodiment of the present invention. According to one example, device 800 may comprise a portable electronic device, such as a mobile telephone. Device 800 may include various modules, such as a digital module 802, an RF module 804, and power management module 806. Digital module 802 may comprise memory and one or more processors. RF module 804, which may comprise RF circuitry, may include a transceiver including a transmitter and a receiver and may be configured for bi-directional wireless communication via an antenna 808. In general, wireless communication device 800 may include any number of transmitters and any number of receivers for any number of communication systems, any number of frequency bands, and any number of antennas. According to an exemplary embodiment of the present invention, power management module 806 may include one or more of voltage regulators 810, which may comprise one or more of device 400 (see FIG. 4), one or more of device 500 (see FIG. 6), or a combination thereof.

Exemplary embodiments of the present invention, voltage regulators with charge-sharing loops may reduce area and/or input/output voltage ripple for periodic loads without loss of efficiency. Exemplary embodiments may be applicable to linear voltage regulators, which are very common building in various analog, mixed signal and RF products. The present invention includes a rather simple yet elegant solution and it is not limited to an specific circuit implementation. Compared to a linear LDO, there is no significant loss of efficiency. For a linear LDO, a total charge may be drawn from a supply voltage and delivered to target block. For the introduced charge sharing LDO, the same charge may be drawn and delivered to load in two steps. Further, the total power consumption may be substantially the same, and the only difference is, compared to power dissipation inside a linear LDO, the power dissipation in the present invention is divided into power dissipation of a main LDO plus an auxiliary LDO and a switch. Any extra overhead due to power need of a second loop may be neglected in practical cases.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the exemplary embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the exemplary embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the exemplary embodiments shown herein but is to be accorded the widest scope consistent with the principles and novel features disclosed herein.

What is claimed is:

1. A device, comprising:

a first energy storage element coupled to an output;

a second energy storage element configured to selectively and periodically couple to the first energy storage element and the output based on an active load period of a load coupled to the output;

a voltage regulator coupled between an input and the second energy storage element, the voltage regulator is configured to receive a feedback voltage, which is a voltage of the first energy storage element, and charge the second energy storage to a voltage based on the feedback voltage; and a second voltage regulator coupled between the input and the first energy storage element configured to charge the first energy storage element.

2. The device of claim 1, wherein each of the first energy storage element and the second energy storage element comprises a capacitor.

3. The device of claim 1, further comprising a switch configured to selectively couple the second energy storage element to the output.

4. The device of claim 1, wherein the voltage regulator is further configured to convey an output voltage based on a voltage ripple at the output.

5. A method, comprising:

charging a first energy storage element coupled to an output of a voltage regulator to a first voltage;

charging a second energy storage element coupled to an output of a second voltage regulator to a second voltage;

coupling periodically the first energy storage element to the second energy storage element during an active load period to compensate for a load current at the second energy storage element; and conveying a feedback voltage from the second energy storage element to the voltage regulator, wherein the feedback voltage is the second voltage of the second energy storage element, and the first voltage is based on the feedback voltage.

6. A device, comprising:

a voltage regulator configured to receive an input voltage and convey an output voltage to a first node;

a first energy storage element coupled to the first node;

a second energy storage element coupled to an output node;

a switch configured to periodically couple the first energy storage element to the output node during an active load period at the output node, wherein the voltage regulator is configured to receive a feedback voltage from the output node, the feedback voltage is a voltage of the second energy storage element, and the output voltage is based on the feedback voltage; and a second voltage regulator configured to receive the input voltage and convey an output voltage to the output node.

7. The device of claim 6, wherein a voltage at the output node is less than a voltage at the first node.

8. The device of claim 6, wherein the second energy storage element is configure to be charged to a target DC voltage.

9. The device of claim 6, wherein the output node is configured to couple to a target block.

10. The method of claim 5, further comprising receiving an input voltage at the voltage regulator and the second voltage regulator.

11. The method of claim 5, wherein charging the second energy storage element to a second voltage comprises charging the second energy storage element to the second voltage less than the first voltage.

12. A method, comprising:

conveying a first output voltage from a first voltage regulator to a first capacitor coupled to an output;

conveying a second output voltage from a second voltage regulator to a second capacitor;

selectively and periodically coupling the second capacitor to the output during an active load period to compensate for a load current at the output; and conveying a feedback voltage from the output to the second voltage regulator, wherein the feedback voltage is a voltage of the first capacitor, and the second output voltage is based on the feedback voltage.

13. The method of claim 12, wherein conveying a first output voltage comprises charging the first capacitor to a target DC voltage.

14. The method of claim 12, wherein conveying a second output voltage comprises charging the second capacitor based on a voltage ripple at the output.

15. The method of claim 12, further comprising receiving an input voltage at each of the first voltage regulator and the second voltage regulator.

16. A device, comprising:

means for charging a first energy storage element coupled to an output of a voltage regulator to a first voltage;

means for charging a second energy storage element coupled to an output of a second voltage regulator to a second voltage; and means for coupling periodically the first energy storage element to the second energy storage element during an active load period to compensate for a load current at the output, wherein the means for charging the second energy storage element receives a feedback voltage from the output, the feedback voltage is the second voltage of the second energy storage element, and the second voltage is based on the feedback voltage.

17. A device, comprising:

means for conveying a first output voltage from a first voltage regulator to a first capacitor coupled to an output;

means for conveying a second output voltage from a second voltage regulator to a second capacitor; and means for selectively and periodically coupling the second capacitor to the output during an active load period to compensate for a load current at the output, wherein the second voltage regulator receives a feedback voltage from the output, the feedback voltage is a voltage of the first capacitor, and the second output voltage is based on the feedback voltage.

* * * * *